US009108767B2

(12) United States Patent
Mateo Peralta

(10) Patent No.: US 9,108,767 B2
(45) Date of Patent: Aug. 18, 2015

(54) DEVICE FOR THE INDIVIDUAL TRANSPORT OF FRUIT

(75) Inventor: Gracián Mateo Peralta, Santa María del Águila (ES)

(73) Assignee: EJIDO CARTÓN, S.L., Santa Maria del Águila (Almeriá) (ES)

( * ) Notice: Subject to any disclaimer, the term of this patent is extended or adjusted under 35 U.S.C. 154(b) by 44 days.

(21) Appl. No.: 14/114,553

(22) PCT Filed: Apr. 26, 2012

(86) PCT No.: PCT/ES2012/070283

§ 371 (c)(1),
(2), (4) Date: Jan. 22, 2014

(87) PCT Pub. No.: WO2012/146818

PCT Pub. Date: Nov. 1, 2012

(65) Prior Publication Data

US 2014/0145459 A1 May 29, 2014

(30) Foreign Application Priority Data

Apr. 29, 2011 (ES) ..... 201130682

(51) Int. Cl.
*A45F 5/00* (2006.01)
*B65D 30/06* (2006.01)
(Continued)

(52) U.S. Cl.
CPC . *B65D 29/04* (2013.01); *A45C 3/04* (2013.01); *A45C 3/045* (2013.01); *A45C 11/20* (2013.01); *A45C 13/1084* (2013.01); *A45C 13/26* (2013.01); *B65D 33/06* (2013.01); *B65D 33/1683* (2013.01); *B65D 85/34* (2013.01)

(58) Field of Classification Search
CPC ..... B65D 85/34; B65D 29/04; B65D 7/20; B65D 7/14; B65D 29/00; B65D 88/1681; B65D 33/14; B65D 33/243; B65D 33/06; B65D 33/1683; A45C 3/04; A45C 3/045; A45C 11/20; A45C 13/1084; A45C 13/26; B65G 7/12; A45F 5/10; A45F 2005/1073; A45F 5/1026; A47G 7/047; A01G 9/104; A01G 23/04; D06F 95/006; B31B 17/00
USPC ..... 294/137, 152; 47/73, 76, 78; 220/485, 220/489–491, 493; 383/7, 117
See application file for complete search history.

(56) References Cited

U.S. PATENT DOCUMENTS 403,928 A * 5/1889 Emeric ..... 383/6
3,322,176 A * 5/1967 Geller ..... 383/6
(Continued)

FOREIGN PATENT DOCUMENTS

CN 201157066 12/2008
ES 170548 3/1973
(Continued)

OTHER PUBLICATIONS

International Search Report issued Aug. 28, 2012 in International (PCT) Application No. PCT/ES2012/070283.

*Primary Examiner* — Stephen Vu
(74) *Attorney, Agent, or Firm* — Wenderoth, Lind & Ponack, L.L.P.

(57) ABSTRACT

A device for the individual transport of fruit, comprising a single integral part, which comprises a central base (13) which is the starting point for a series of concentric sections (4) all of which are arranged in a single circumferential direction, and end in short end portions (6-6') which connect to two handle structures (7) which comprise a hooking device in order to stabilize the position for use of the integral part in which is defined a shell space which houses the fruit, such as a watermelon (1), the surface of which closely matches the various elements of the integral part. Thus, in the operative position for use, the device according to the invention has a basket-type structure which closely matches the outer surface of the fruit.

21 Claims, 6 Drawing Sheets

(51) Int. Cl.

| | |
|---|---|
| ***A45C 3/04*** | (2006.01) |
| ***A45C 11/20*** | (2006.01) |
| ***B65D 85/34*** | (2006.01) |
| ***A45C 13/10*** | (2006.01) |
| ***A45C 13/26*** | (2006.01) |
| ***B65D 33/06*** | (2006.01) |
| ***B65D 33/16*** | (2006.01) |

(56) References Cited

U.S. PATENT DOCUMENTS 5,454,191 A * 10/1995 Mayeda et al. ..... 47/65.8
5,495,692 A * 3/1996 LoJacono, Jr. ..... 47/78
2010/0000149 A1* 1/2010 Ouellet et al. ..... 47/32.7

FOREIGN PATENT DOCUMENTS

| | | |
|---|---|---|
| ES | 202841 | 4/1976 |
| ES | 211409 | 10/1976 |
| ES | 1 028 262 | 12/1994 |
| JP | 2009-131348 | 6/2009 |
| KR | 2005-0092689 | 9/2005 |
| KR | 20-0446845 | 12/2009 |
| KR | 2011-0000274 | 1/2011 |
| KR | 2011-0042887 | 4/2011 |

* cited by examiner

DEVICE FOR THE INDIVIDUAL TRANSPORT OF FRUIT

OBJECT OF THE INVENTION

The present invention, as expressed in the wording of this specification, relates to a device for the individual transport of fruit, in which operative position for use presents a basket-type structure which closely matches the outer surface of the fruit, such as a watermelon, and in general any other product or body with an approximately spherical configuration, given that due to their weight or size, they usually present inconveniences for their manipulation and/or transport.

In addition to watermelons, the device is applicable to, for example, the transport of cabbages, purple cabbages, cauliflowers, etc.

The device of the invention presents the advantage of being able to be easily placed on the outer surface of the fruit, thereby being very cheap given its disposable nature, with which the device of the invention can be distributed free of charge with the product sold by the point of sale itself.

Therefore, the objective of the invention is a device to transport watermelons and similar products, intended to facilitate the transport of said products in a very comfortable manner for the user by occupying a very small space in the deployed position when the device of the invention is not in use.

BACKGROUND OF THE INVENTION

There are many means to transport fruit and vegetables, including watermelons, melons, and other similar products, that are currently known among which we have bags made of plastic and other materials.

The bag for the transport of fruit corresponding to utility model no. 200601179 is also known, which is intended for the TRANSPORT OF MELONS, WATERMELONS AND SIMILAR PRODUCTS, transport that is carried out in an individual basis. This bag basically comprises a cardboard laminar body that, once assembled, delimits a shell space where the corresponding product, such as a watermelon or melon, is housed and fastened. This bag also has a fasting handle that is shaped when the bag in question is assembled.

Utility model no. 9401608 is also known, which consists of a HANDLE FOR THE TRANSPORT OF SPHERICAL FRUITS, MAINLY WATERMELONS. It is characterized in that it comprises a single integral body having a handle per se, which expands such that the narrowed part has a retaining fin forming a slot for the passage of the opposite end, all of which is between said expansion and the handle; it becomes narrowed once again and a section bifurcates, continues in parallel, and joins in a symmetrical manner, converging in a long strip showing an engraving perpendicular to its length and matching the fin in one of its faces in thickness.

DESCRIPTION OF THE INVENTION

The device for the individual transport of fruit formed in principle by a single integral part made of plastic.

It is characterized in that:

It comprises a central base which is the starting point for a series of concentric sections all of which are arranged in a single circumferential direction.

The concentric sections end in first end portions and in second end portions.

The first and second end portions are joined to two handle structures.

The handle structures comprise a hooking means in order to stabilise the position for use of the integral part in which is defined a shell space which houses the fruit, the surface of which closely matches the various elements of the plastic integral part.

Each one of the handle structures comprises a curved handle per se and a cross member at which ends they are joined to the respective curved handle, and they are also characterized in that the second end portions are joined to the free ends of the curved handles, while the first end portions are joined at the centre of the cross members forming part of the handle structures.

Each one of the cross members of the handle structures comprises two symmetrical branches, each one of which in turn comprises a longer arched section and a shorter end section.

Another feature of the invention is that the hooking means of the handle structures comprise a tongue and a groove, the latter being defined by a window delimited between a bridge and a portion of the respective curved handle, while the tongue comprises a T-shaped tab, which starting point is the centre of the other matching curved handle and is inserted through the aforementioned window.

As an alternative to the foregoing, the hooking means of the handle structures comprise a pair of tongues and a pair of grooves, integrated in extensions forming part of the curved handles, such that the grooves comprise through openings, while the tongues comprise a pair of harpoon-shaped tabs introduced through the through openings to be anchored in the respective extensions.

The device for the individual transport of fruit is also characterized in that:

The central base comprises a centred body arranged with a circumferential configuration, several radiuses, angularly equidistant to one another which starting point is the centred body, and several ties joined to the diverging end sections of the radiuses.

The concentric sections start from the radiuses as an extension thereof.

The radiuses start from the small centred body following an arched trajectory.

The ties joining adjacent radiuses comprise an arched trajectory and are provided with curved end sections in opposition to each other.

The arched trajectory of the ties follows the curvature of the concentric sections.

The first and second end portions are straight and converge towards the centre of the central base.

Another feature of the invention is that the curved handles comprise a structure having a circumferential trajectory with an angular amplitude delimited between 150 and 180°, while said curved handles end in straight end sections.

On the other hand, the concentric sections comprise an angular amplitude between 150 and 180°.

Another characteristic of the invention is that the ends of the two handle structures are connected by means of sinuous sections in the form of a spring, with the interposition of the respective end portions.

Considering the second embodiment of the invention, the handle structures configure a general U-shaped configuration, which lateral branches diverge towards their free ends connected to the second end portions, while the lateral branches are joined by means of a cross member and the first end portions are joined at the centre of the cross members forming part of the handle structures.

In the second embodiment of the invention, the hooking means of the handle structures comprise tongues and grooves, the latter comprising slots established in the lateral branches of one of the handle structures, while the tongues comprise double harpoon-shaped pins, which starting point is the other matching handle structure, said double harpoon-shaped pins being introduced by snap-fitting through the aforementioned slots.

In the second embodiment we are describing, the central base comprises a clover-shaped configuration, which leaves comprise double curved portions which are the starting point of the different concentric sections, which free ends are connected to the first and second end portions, which comprise a curved configuration.

Next, in order to facilitate a better comprehension of this specification, and being an integral part thereof, figures representing the object of the invention in an illustrative rather than limitative manner have been attached.

DESCRIPTION OF AN EXAMPLE OF AN EMBODIMENT OF THE INVENTION

Taking into account the numbering adopted in the figures, the device for the individual transport of fruit contemplates the following nomenclature, used in the description:

1.—Fruit.
2.—Centred body.
3.—Arched radiuses.
4.—Concentric sections.
5.—Arched ties.
6.—First end portions.
6'.—Second end portions.
7.—Handle structure.
7'.—Handle structure.
8.—T-shaped tab.
8'.—Harpoon-shaped tab.
9.—Window.
9*a*.—Bridge.
9*b*.—Portion.
91.—Openings.
10.—Curved handle.
11.—Cross member.
12.—Sinuous section.
13.—Central base.
13'.—Central base.
14.—Extensions.
15.—Double curved portions.
16.—Lateral branches.
17.—Double harpoon-shaped pins.
18.—Slots.
19.—Transverse tie.
20.—Transverse branches.

It is determined in principle by an integral body made of plastic, in which position for use it adopts a frame in the shape of a cage delimiting an internal shell space where a watermelon 1, or another similar product, is housed and located, the surface of which closely matches the outer surface of the watermelon.

Figure 1:
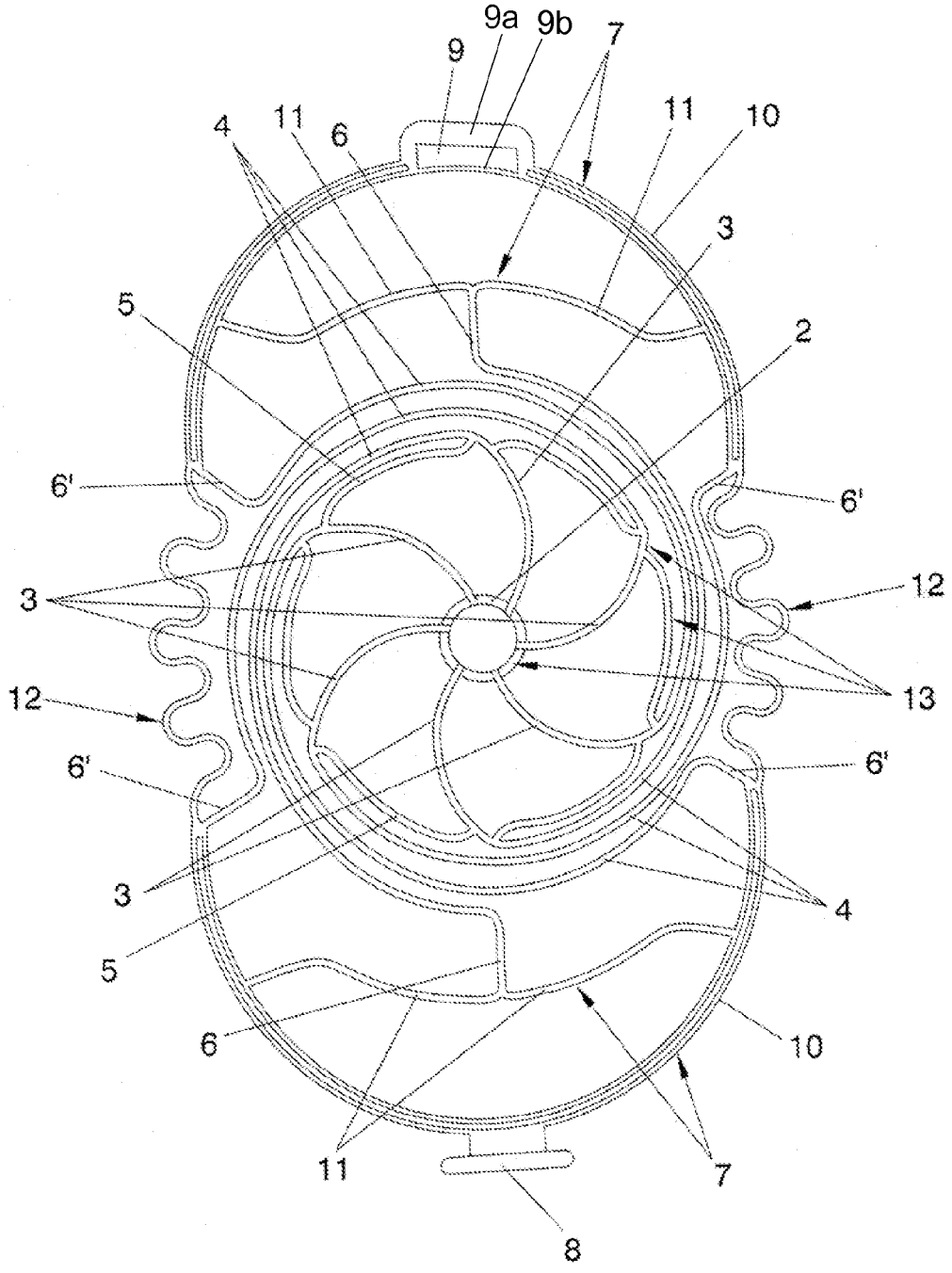
FIG. 1.—Shows a deployed view of the device for the individual transport of fruit object of the invention, according to a first embodiment. The fruit held by the device of the invention is a watermelon.
Figure 2:
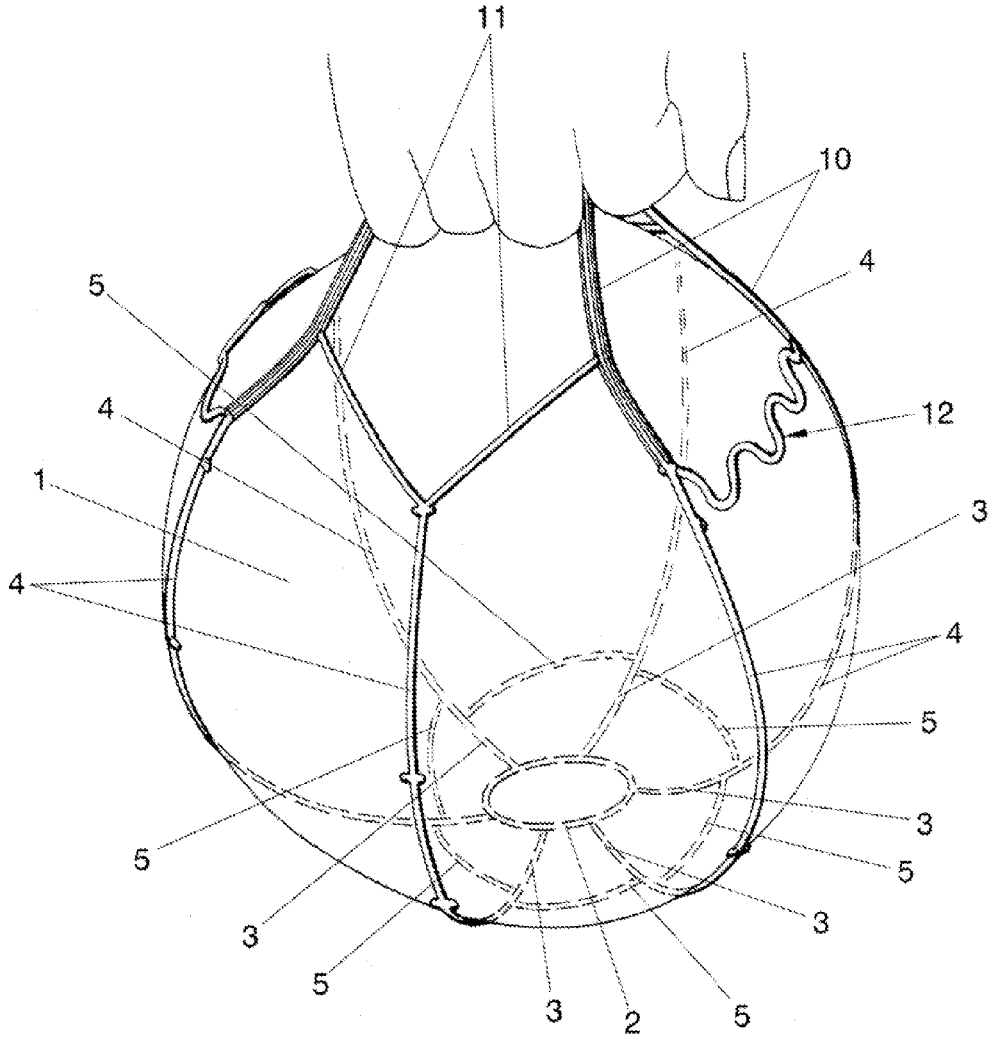
FIG. 2.—Shows a perspective view of the device represented in the previous figure, which defines a shell space which housing a watermelon, the surface of which closely matches the various elements composing the device of the invention.
Figure 3:
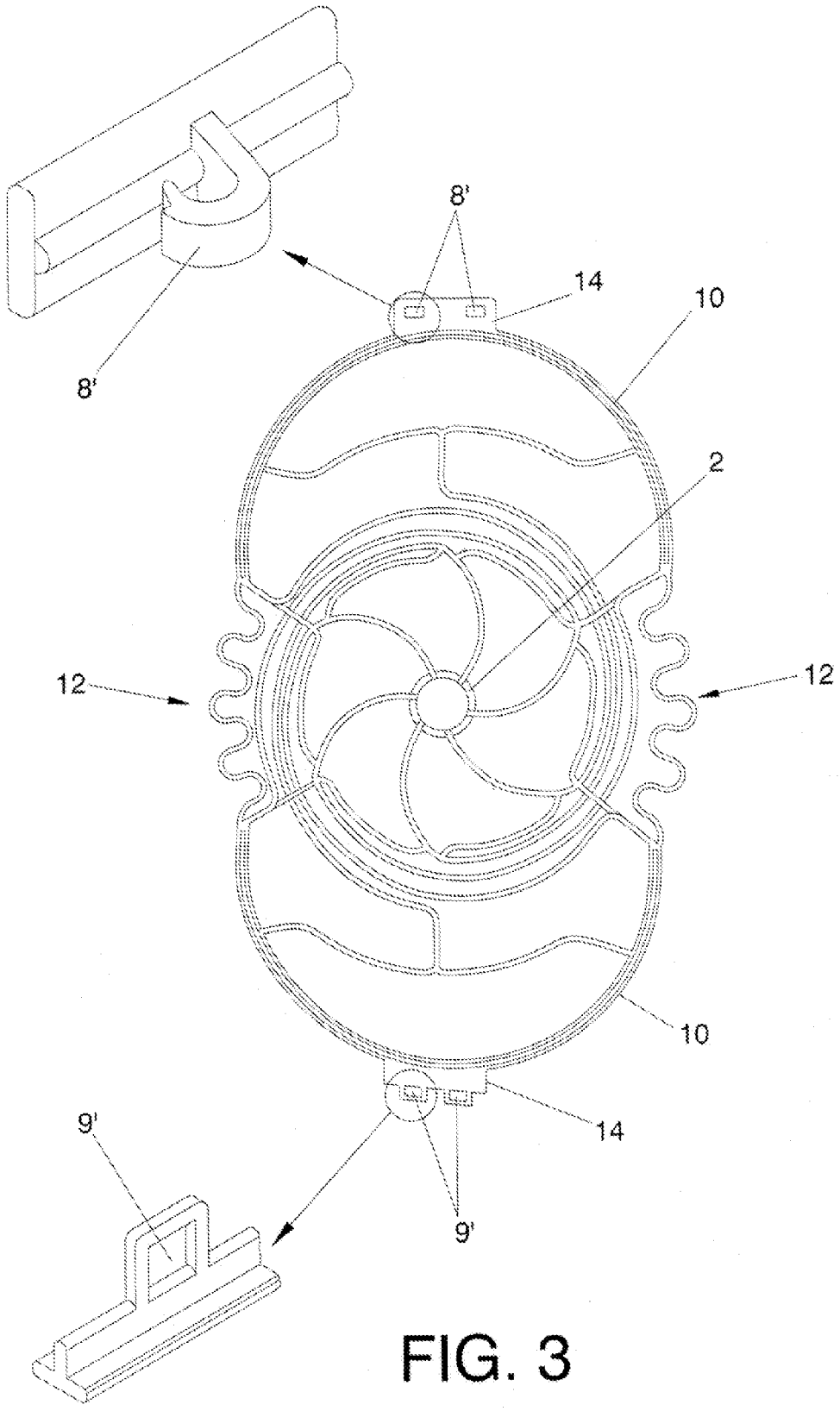
FIG. 3.—Shows a view similar to FIG. 1, which integrates hooking means to stabilise the position for use of the device, means that are different than the ones shown in the previous figures.

In principle, taking FIGS. 1, 2 and 3 into account, the integral body comprises a central base 13, formed by a small centred body 2 with an angular configuration, several arched radiuses 3 angularly equidistant to one another which starting point is said centred body 2, and several ties 5, joined to the diverging end sections of the radiuses 3, the diverging ends of said arched radiuses 3 being extended in concentric sections 4, each one of which comprises an angular amplitude of approximately 180°, all of which are arranged in a single circumferential direction with an angular offset according to the angular offset between the radiuses 3.

As referred to above, the arched radiuses 3 are joined to one another by their diverging end sections by means of the ties 5, which are also arched, and are provided with curved end sections in opposition to each other, ties 5 that follow the curvature of the concentric sections 4.

The free ends of said concentric sections 4 extend in first 6 and second 6' short end portions, which are straight and converge towards the small centred body 2, and in turn are joined at their free ends to two handle structures 7 having at least one tongue and at least one groove to anchor to one another, thereby ensuring the position for use of the set of the device of the invention, formed by a single integral part made of plastic.

The handle structures 7 comprise a curved handle 10 per se and a cross member 11, in which centre the first end portions 6 converge. Said cross member 11 comprises two symmetrical branches, each one of which in turn comprises an initial arched section and a bent short end section joined to the respective curved handle 10. The two curved handles 10 follow a circumferential trajectory with an angular amplitude of approximately 180°.

The second end portions 6' are joined to the ends of the curved handles 10, while the opposite ends of different curved handles 10 are joined by means of sinuous sections 12 in the form of a spring. It should be noted that the curved handles 10 end in straight end sections.

The tongues and grooves are integrated in centred areas in opposition to the curved handles 10, while they also face towards the same direction, the tongue comprising a T-shaped tab 8 in one embodiment, while the groove comprises a through window 9, delimited by a bridge 9*a* and a portion 9*b* of the respective curved handle 10, the T-shaped tab 8 being introduced inside the window 9 of the groove to ensure the anchoring and assembly of the device of the invention in its position for use (FIG. 1).

In another embodiment, shown in FIG. 3, the hooking means of the handle structures 7 comprise a pair of tongues and a pair of grooves, integrated in extensions 14 forming part of the curved handles 10. In this case, the grooves comprise through openings 9', while the tongues comprise a pair of harpoon-shaped tabs 8' to anchor to the aforementioned grooves.

Figure 4:
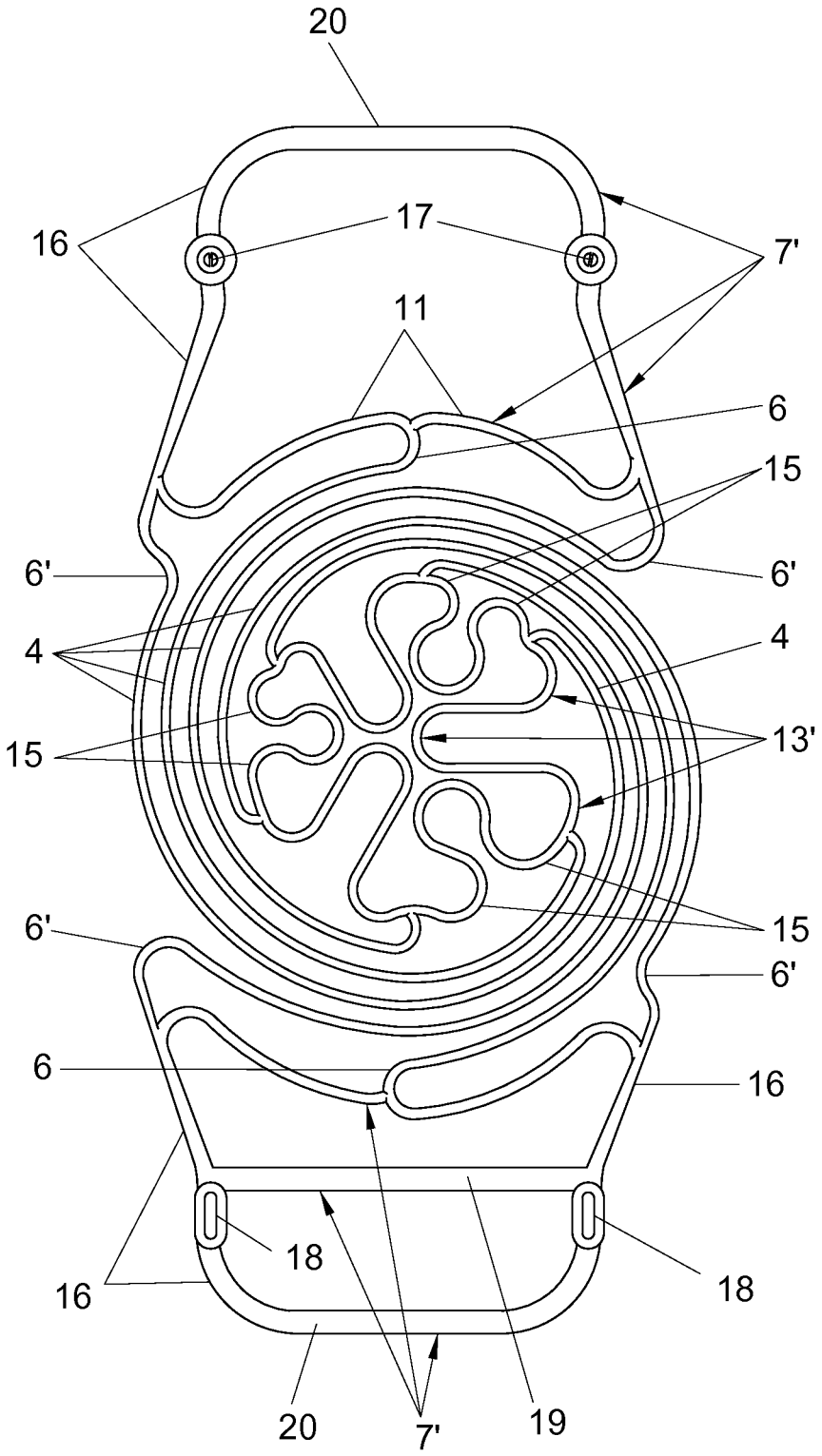
FIG. 4.—Shows a deployed view of the device of the invention according to another embodiment of the invention.
Figure 5:
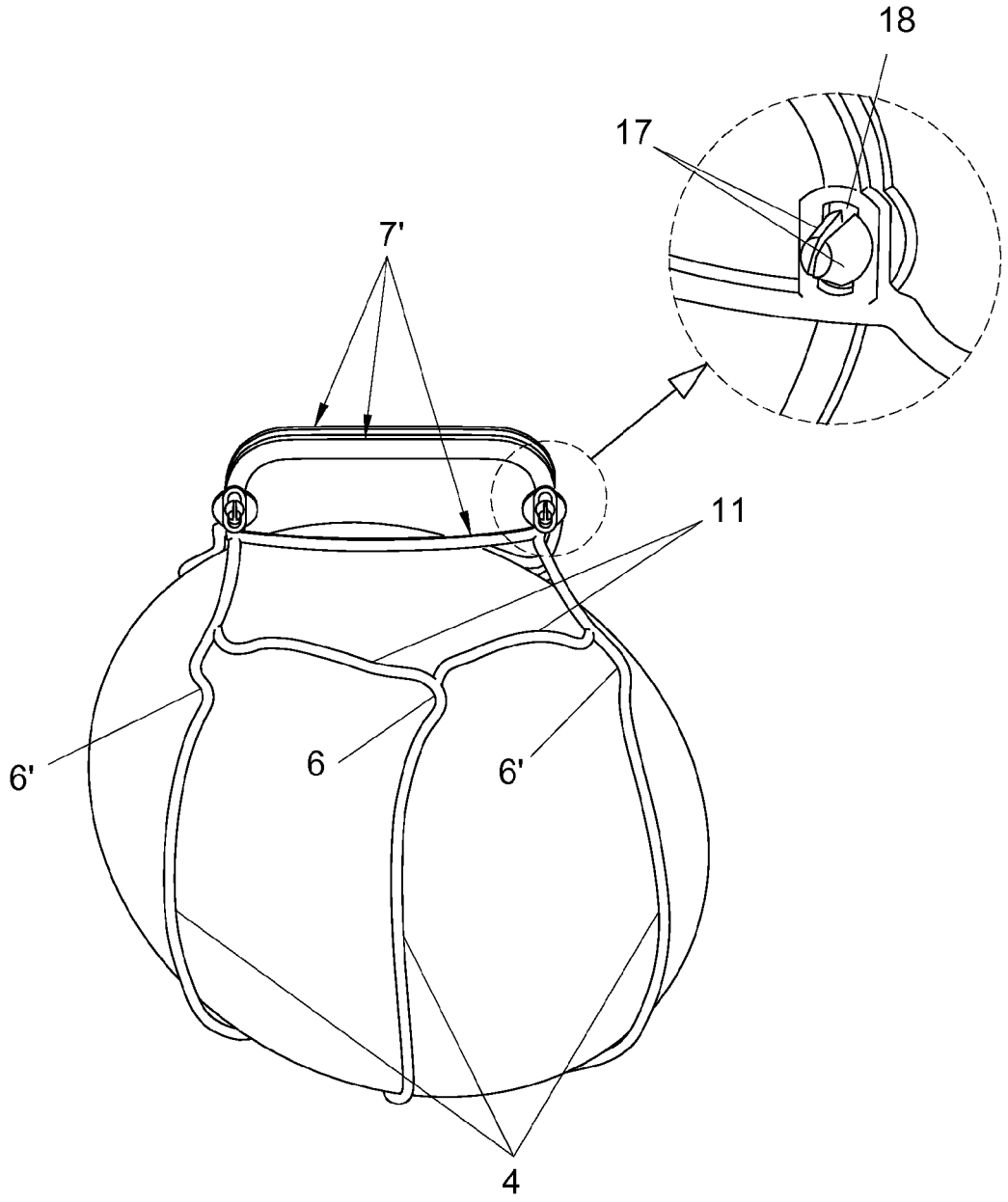
FIG. 5.—Shows a perspective view of the application of the device represented in FIG. 4.
Figure 6:
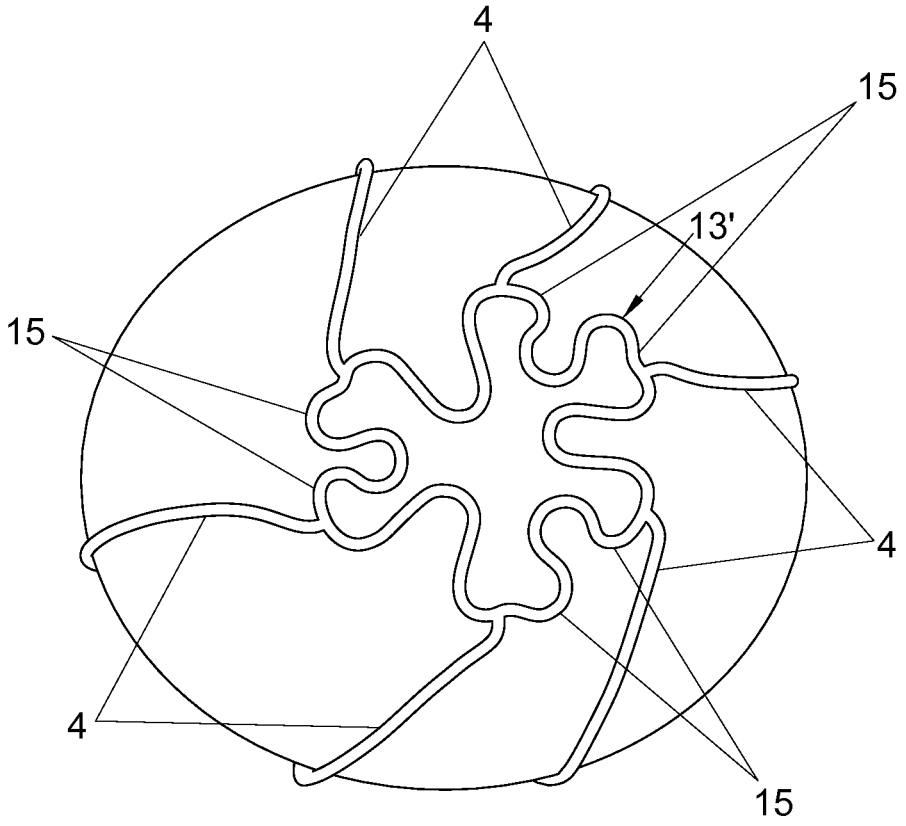
FIG. 6.—Shows another perspective view of the application of the device of the invention represented in the two previous figures.

Taking into account FIGS. 4, 5 and 6, the device of the invention presents certain variations with respect to the description made up to this point, which focus on the handle structures, the central base, and the tongues and grooves integrated to the handle structures to anchor to one another with the purpose of ensuring the position for use of the set of the device of the invention. The sinuous sections 12 have been eliminated, which are also unnecessary in the previous embodiments.

Thus, in this new embodiment shown in FIGS. 4, 5, and 6, a new central base 13' has been envisaged in the general shape of a clover, which leaves comprise double curved portions 15, which are the starting point of the different concentric sections 4, which free ends connect to the first 6 and second 6' end portions presenting a curved configuration, unlike the straight configuration of the embodiment shown in FIGS. 1, 2, and 3.

In this new embodiment, the handle structures 7' comprise a general U-shaped configuration, which lateral branches 16 diverge towards the free ends connected to the second portions 6'.

The lateral branches 16 of the two handle structures 7' incorporate double harpoon-shaped pins 17 that are hooked by snap-fitting to slots 18 facing each other, which are established in the lateral branches 16 of the other matching handle structure 7'. At least this handle structure 7' integrating the slots 18 incorporates a transverse tie 19 joining the lateral branches 16 of the aforementioned handle structure 7'.

In this new embodiment, the lateral branches 16 of the handle structures 7' are joined by means of the matching cross members 11, which centres are the starting point of the first portions 6 in which two of the concentric sections 4 end.

Once the device of this embodiment, shown in FIGS. 4,5, and 6, is assembled, the transverse branches 20 of the handle structures 7' constitute the handle per se, which is grabbed by the hand for the transport of the product held by the device of the invention.

As shown in FIGS. 2, 5, and 6, during the application and use of the device of the invention, the integral body made of plastic is distorted and stretched, adapting to the outer surface of the watermelon 1, with which the concentric sections 4, along with the first 6 and second 6' end portions, adopt a configuration in the form of meridians of a spherical body, while the symmetrical branches of the cross members 11 of the handle structures 7-7' constitute portions of the sections of the parallels of said spherical body, as is the case with the two sinuous sections 12 (in the embodiment in which they are incorporated) joining the different ends of the two handle structures 7-7', thereby maintaining this sinuous trajectory that allows adopting the device of the invention to different watermelon sizes, matching the device to the outer surface of the watermelon 1 and hugging the same in safe and stable manner.

In the position for use of the device of the invention, the two cross member branches 11 can be arranged in the same direction or form an angle between them, depending on the weight and volume of the watermelon 1.

On the other hand, the watermelon 1 shall rest on the central base 13-13', which shall adopt a surface configuration of a spherical cap according to the lower part of the watermelon 1.

The invention claimed is:

1. A device for the individual transport of fruit, comprising a single integral part, wherein:

the device comprises a central base which is the starting point for a series of concentric sections all of which are arranged in a single circumferential direction;

the concentric sections end in first end portions and in second end portions;

the first and second end portions are joined to two handle structures;

the handle structures comprise a hooking device in order to stabilize a position for use of the integral part in which is defined a shell space which houses the fruit, where a surface of the fruit closely matches the integral part;

the hooking device of the handle structures comprises a tongue and a groove;

the groove is defined by a window delimited between a bridge and a portion of the respective curved handle;

the tongue comprises a T-shaped tab, which starting point is the center of the other matching curved handle and is inserted through the window.

2. A device for the individual transport of fruit according to claim 1, wherein:

each one of the handle structures comprises a curved handle and a cross member whose ends are joined to the respective curved handle;

the second end portions are joined to free ends of the curved handles;

the first end portions are joined at the center of the cross members forming part of the handle structures.

3. A device for the individual transport of fruit according to claim 1, wherein:

the central base comprises a small centered body arranged with a circumferential configuration, several radiuses, angularly equidistant to one another which starting point is the centered body, and several ties joined to the diverging end sections of the radiuses;

the concentric sections start from the radiuses as an extension thereof;

the radiuses start from the centered body following an arched trajectory;

the ties joining adjacent radiuses comprise an arched trajectory and are provided with curved end sections in opposition to each other;

the arched trajectory of the ties follows the curvature of the concentric sections.

4. A device for the individual transport of fruit according to claim 1, wherein:

the curved handles comprise a structure having a circumferential trajectory with an angular amplitude delimited between 150 and 180°;

the curved handles end in straight end sections.

5. A device for the individual transport of fruit according to claim 1, wherein each one of the cross members of the handle structures comprises two symmetrical branches, each one of which in turn comprises a longer arched section and a shorter end section.

6. A device for the individual transport of fruit according to claim 1, wherein the first and second end portions are straight and converge towards the center of the central base.

7. A device for the individual transport of fruit according to claim 1, wherein the concentric sections comprise an angular amplitude between 150 and 180°.

8. A device for the individual transport of fruit comprising a single integral part, wherein:

the device comprises a central base which is the starting point for a series of concentric sections all of which are arranged in a single circumferential direction;

the concentric sections end in first end portions and in second end portions;

the first and second end portions are joined to two handle structures;

the handle structures comprise a hooking device in order to stabilize a position for use of the integral part in which is defined a shell space which houses the fruit, where a surface of the fruit closely matches the integral part;

the hooking device of the handle structures comprises a pair of tongues and a pair of grooves, integrated in extensions forming part of the curved handles the grooves comprise through openings;

the tongues comprise a pair of harpoon-shaped tabs introduced through the through openings to be anchored in the respective extensions.

9. A device for the individual transport of fruit according to claim 8, wherein:

each one of the handle structures comprises a curved handle and a cross member whose ends are joined to the respective curved handle;

the second end portions are joined to free ends of the curved handles;

the first end portions are joined at the center of the cross members forming part of the handle structures.

10. A device for the individual transport of fruit according to claim 8, wherein:

the central base comprises a small centered body arranged with a circumferential configuration, several radiuses, angularly equidistant to one another which starting point is the centered body, and several ties joined to the diverging end sections of the radiuses;

the concentric sections start from the radiuses as an extension thereof;

the radiuses start from the centered body following an arched trajectory;

the ties joining adjacent radiuses comprise an arched trajectory and are provided with curved end sections in opposition to each other;

the arched trajectory of the ties follows the curvature of the concentric sections.

11. A device for the individual transport of fruit according to claim 8, wherein:

the curved handles comprise a structure having a circumferential trajectory with an angular amplitude delimited between 150 and 180°;

the curved handles end in straight end sections.

12. A device for the individual transport of fruit according to claim 8, wherein each one of the cross members of the handle structures comprises two symmetrical branches, each one of which in turn comprises a longer arched section and a shorter end section.

13. A device for the individual transport of fruit according to claim 8, wherein the first and second end portions are straight and converge towards the center of the central base.

14. A device for the individual transport of fruit according to claim 8, wherein the concentric sections comprise an angular amplitude between 150 and 180°.

15. A device for the individual transport of fruit comprising a single integral part, wherein:

the device comprises a central base which is the starting point for a series of concentric sections all of which are arranged in a single circumferential direction;

the concentric sections end in first end portions and in second end portions;

the first and second end portions are joined to two handle structures;

the handle structures comprise a hooking device in order to stabilize a position for use of the integral part in which is defined a shell space which houses the fruit, where a surface of the fruit closely matches the integral part;

the hooking device of the handle structures comprise tongues and grooves;

the grooves comprise slots established in the lateral branches of one of the handle structures;

the tongues comprise double harpoon-shaped pins, which starting point is the other matching structure;

the double harpoon-shaped pins are introduced through the slots.

16. A device for the individual transport of fruit according to claim 15, wherein:

the handle structures configure a general U-shaped configuration, which lateral branches diverge towards their free ends connected to the second end portions;

the lateral branches are joined via a cross member;

the first end portions are joined at the center of the cross members forming part of the handle structures;

at least one of the handle structures integrates a transverse branch, which ends are joined to the lateral branches.

17. A device for the individual transport of fruit according to claim 15, wherein:

the central base comprises a clover-shaped configuration, which leaves comprise double curved portions which are the starting point of the different concentric sections, which free ends are connected to the first and second end portions.

18. A device for the individual transport of fruit according to claim 15, wherein the first and second end portions comprise a curved configuration.

19. A device for the individual transport of fruit according to claim 15, wherein each one of the cross members of the handle structures comprises two symmetrical branches, each one of which in turn comprises a longer arched section and a shorter end section.

20. A device for the individual transport of fruit according to claim 15, wherein the concentric sections comprise an angular amplitude between 150 and 180°.

21. A device for the individual transport of fruit comprising a single integral part, wherein:

the device comprises a central base which is the starting point for a series of concentric sections all of which are arranged in a single circumferential direction;

the concentric sections end in first end portions and in second end portions;

the first and second end portions are joined to two handle structures;

the handle structures comprise a hooking device in order to stabilize a position for use of the integral part in which is defined a shell space which houses the fruit, where a surface of the fruit closely matches the integral part;

the ends of the two handle structures are connected via sinuous sections in the form of a spring, with the interposition of respective second end portions.

* * * * *